US005655350A

United States Patent [19]

Patton

[11] Patent Number: 5,655,350

[45] Date of Patent: Aug. 12, 1997

[54] METHOD FOR RETRO-FIT FORMING FIRESTOPS IN EXISTING WALL STRUCTURES WITH BLOWN INSULATION

[76] Inventor: Bruce L. Patton, 1278 Seaview Dr., Vista, Calif. 92084

[21] Appl. No.: 276,304

[22] Filed: Jul. 18, 1994

[51] Int. Cl.[6] ..... E04B 1/00

[52] U.S. Cl. ..... 52/742.13; 52/404.1

[58] Field of Search ..... 52/743, 404.1

[56] References Cited

U.S. PATENT DOCUMENTS

| | | | |
|---|---|---|---|
| 4,134,242 | 1/1979 | Musz et al. | 52/743 X |
| 4,430,840 | 2/1984 | Malwitz | 52/743 |
| 4,471,591 | 9/1984 | Jamison | 52/743 X |
| 4,829,738 | 5/1989 | Moss | 52/743 |
| 5,365,716 | 11/1994 | Munson | 52/743 |

*Primary Examiner*—Carl D. Friedman
*Assistant Examiner*—Creighton Smith

[57] ABSTRACT

A method for retro-fit forming firestops in existing wall structures of apartments, condominiums and other buildings. The method eliminates the need for removing entire drywall panels or strips of drywall panel in order to install the firestops required by 2516 F-2 of the uniform the building code. Access holes are cut at predetermined locations in the drywall panel and the nozzle of an insulation blowing machine is inserted into the access hole. A specially prepared loose insulation material is blown into the access holes into the open spaces that require a firewall and it forms a self supporting damn structure that fills the open spaces and adheres to surrounding structure. The plugs initially formed when cutting the access holes are replaced in their holes and taping and finished coating of the access holes is completed using standard drywall methods.

12 Claims, 3 Drawing Sheets

METHOD FOR RETRO-FIT FORMING FIRESTOPS IN EXISTING WALL STRUCTURES WITH BLOWN INSULATION

BACKGROUND OF THE INVENTION

The invention relates to building structures and more specifically to firewalls that are required by the building codes in selected wall spaces of apartments, condominiums and other buildings.

Building codes are very specific about having vertical and horizontal firestops in specific open spaces found in the walls and ceilings of apartments, condominiums and other buildings. Building contractors do not always install these required firestops during the initial construction of the buildings and therein lies the problem. As a result of law suits against the building contractors, they are now being required to retro-fit existing structures with firestops in the required open spaces between framing structure and walls. Where nothing is mounted on the existing outer drywall surface the contractor can either remove the entire drywall panel or cut away strips of a drywall panel and remove them and install the required firestops. Oftentimes, there may be cabinets or other structure mounted on or behind the outer wall surface such as plumbing or toilets. This makes it expensive to remove the drywall panel or strips to install the required firestops.

It is an object of the invention to provide a novel method for retro-fit forming firestops into selected wall spaces of existing walls of apartments, condominiums and other buildings that eliminates the necessity of removing entire drywall panels or strips thereof.

It is also an object of the invention to provide a novel method for retro-fit forming firestops into selected wall spaces of existing walls of apartments, condominiums and other buildings that is more economical in terms of man-hour time and materials than existing methods.

It is a further object of the invention to provide a novel method for retro-fit forming firestops into selected wall spaces of existing walls of apartments, condominiums and other buildings that will bring the structure up to the required code requirements.

SUMMARY OF THE INVENTION

Apartments, condominiums and other buildings have common or party walls and floor structures that have been designed with one inch or two inch open spaces or gaps between them. There is usually a vertical space between adjacent party walls and the building code requires that there be both vertical and horizontal firestops between the two walls. Usually the studs are staggered on the two walls and the stud bays are filled with batts of fiberglass insulation. These batts loosely fill the respective stud bays but do not provide a positive barrier for fire and it can leap through the existing air spaces. During initial construction of these walls a vertical firestop is usually formed by rolling up a piece of fiberglass insulation and cramming it tightly into the space behind one of the studs to provide a damn or firestop. This is done for the entire height of that particular stud and a separate vertical firestop is constructed at least every 10 feet along the length of the wall.

The stud bays are covered by drywall panels that are nailed to the respective vertically extending studs. A single thickness of drywall is referred to as a one hour wall and a double thickness of drywall is referred to as a two hour wall.

There is usually a lateral open space between the bottom headers or joists at the ceiling of each successive story of an apartment or building. Horizontal firewalls are required by the building code in this horizontal space. During initial construction, a piece of fiberglass insulation is usually rolled up and crammed tightly down into this space and this is performed along the entire horizontal length of this space between the different floors of the building.

The novel method of retro-fit forming horizontal firestops with two hour walls will now be discussed. First access holes are cut in each stud bay along the horizontal plane to expose the second drywall layer. The size of these access holes would be in the range of 2 inches by 2 inches and 6 inches by 6 inches. These access holes are preferably square or diamond shaped. The plugs formed by the cutting operation would then be removed from the access holes. Circular access holes would be cut in the second dry wall layer and these would be aligned with the first access holes. These second access holes would be in the range of 1 inch to 2½ inches in diameter. In any ceiling height greater than 10 feet, it would be necessary to cut additional access holes along a horizontal plane at that height to form a second horizontal firestop. For forming vertical firestops, first access holes would be cut at vertical spacings of approximately 2–4 feet adjacent one of the vertically oriented stud members, and the first plugs removed thereby exposing a second layer of drywall. A circular second access hole would be cut in the second layer of drywall in alignment with the first access hole. The second plugs would be removed from the second access holes. Additional vertical firestop access holes would be cut at 10 foot horizontal spacings if the wall is longer than 10 feet.

A conventional state of the art insulation blowing machine would be used to form the required firestops. The insulation blowing machine would have either a water injection structure incorporated in its hose or some type of adhesive would be added to the insulation so that as it is pumped into the wall under pressure it will both stick to any surface that it contacts and also to itself form a crust-like bridge or damn formation that acts like a firestop. Prior to inserting the nozzle of the air blowing machine into the access hole, a rod with a bend on its end or some other type of like tool would be inserted into the hole to push the insulation inside the hole away from the mouth of the hole and to compress it into approximately a 1 inch space. The nozzle of he hose is then fed into the access hole until it is adjacent the open space that requires the firestop. The machine is turned on and as the open space or cavity fills the material can be heard and seen passing through the transparent hose tube. Increasing the flow rate creates a material bridge, which is then compressed into place. As the filling continues, the material flowing into the cavity will seal off the end of the tube causing a material stoppage that can be heard, as well as felt, as an increase in back pressure forms in the tube. At this point the hose may be withdrawn approximately 6 to 8 inches or until material begins to flow again. When the desired amount of insulation has been blown into the area, the machine is stopped and the hose removed.

If the structure has two hour walls, then the round plug from the second access hole would be replaced and an adhesive in the form of all purpose drywall mud applied to hold it in place. Next a thin coat of adhesive all purpose drywall mud would be applied to the back and sides of the first plug and it would be reinstalled using laminating screws. Next the standard drywall method of taping and finishing would take place. If the structure only involves one hour walls or party walls, only a round access hole would have been cut in the drywall and its round plug would need to be replaced. It would be held in position by adhesive all purpose drywall mud. Next adhesive hole patch would be applied and the standard drywall method of taping and finishing would be used.

DESCRIPTION OF THE PREFERRED EMBODIMENT

Figure 1:
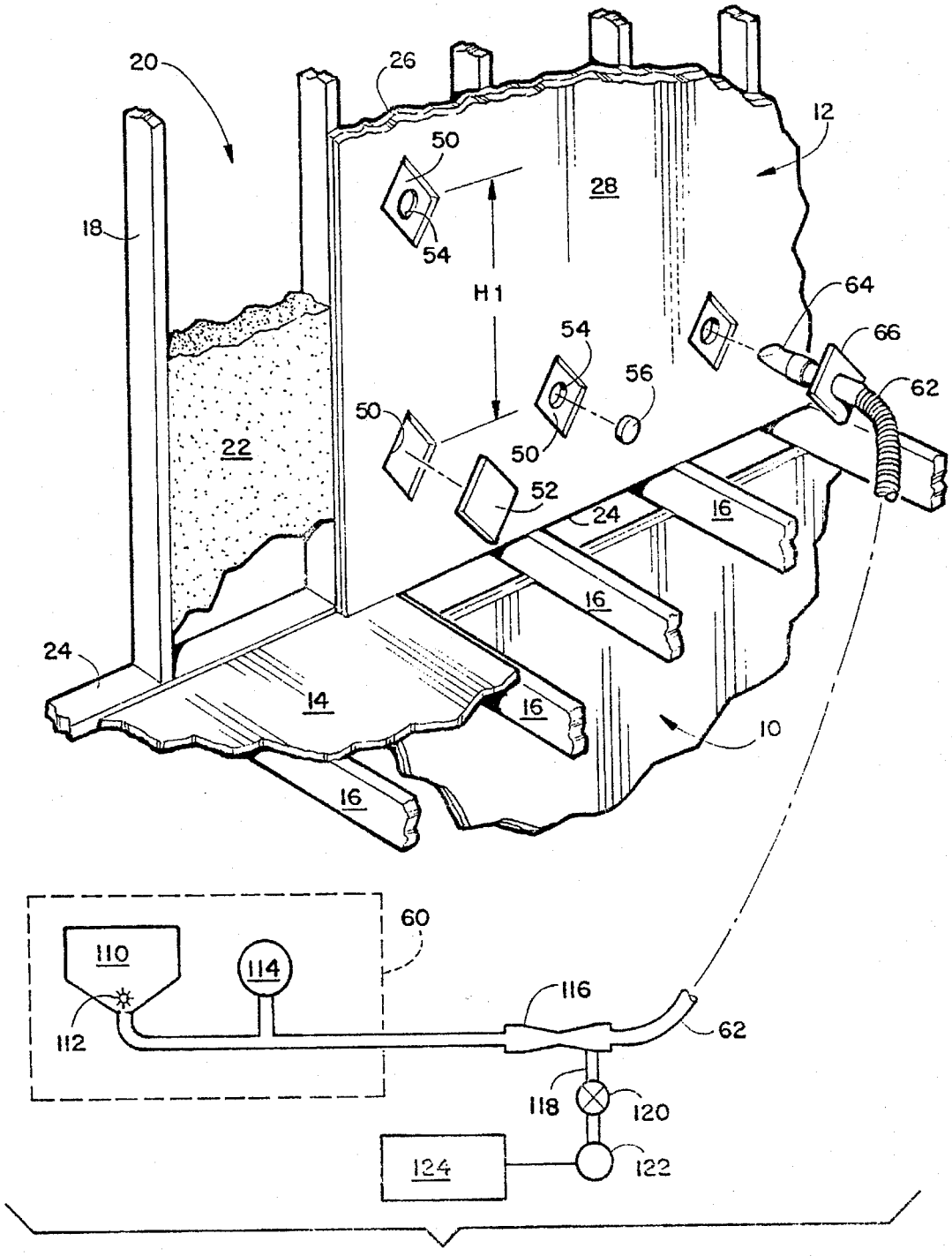
FIG. 1 is a front perspective view illustrating one side of a two hour party wall with some portions broken away and some structure shown in exploded view.

The novel method for retro-fit forming firestops in existing wall structures with blown insulation will now be described by referring to FIGS. 1–6 of the drawings. FIG. 1 illustrates a common or party wall of a multi-story building. The first story is identified by numeral 10 and the second story is identified by the numeral 12. A floor 14 is supported on a plurality of joists 16. Extending upwardly from floor 14 are a plurality of laterally spaced studs 18. A stud bay 20 is formed between each pair of studs. A batt 22 of insulation generally fills a stud bay. A bottom plate 24 extends along the bottom edge of the respective stud bays 20. A first layer of drywall 26 covers the respective stud bays and this is known as a one hour wall. A second layer of drywall 28 may cover the first layer and this forms what is then known as a two hour fire wall.

Figure 2:
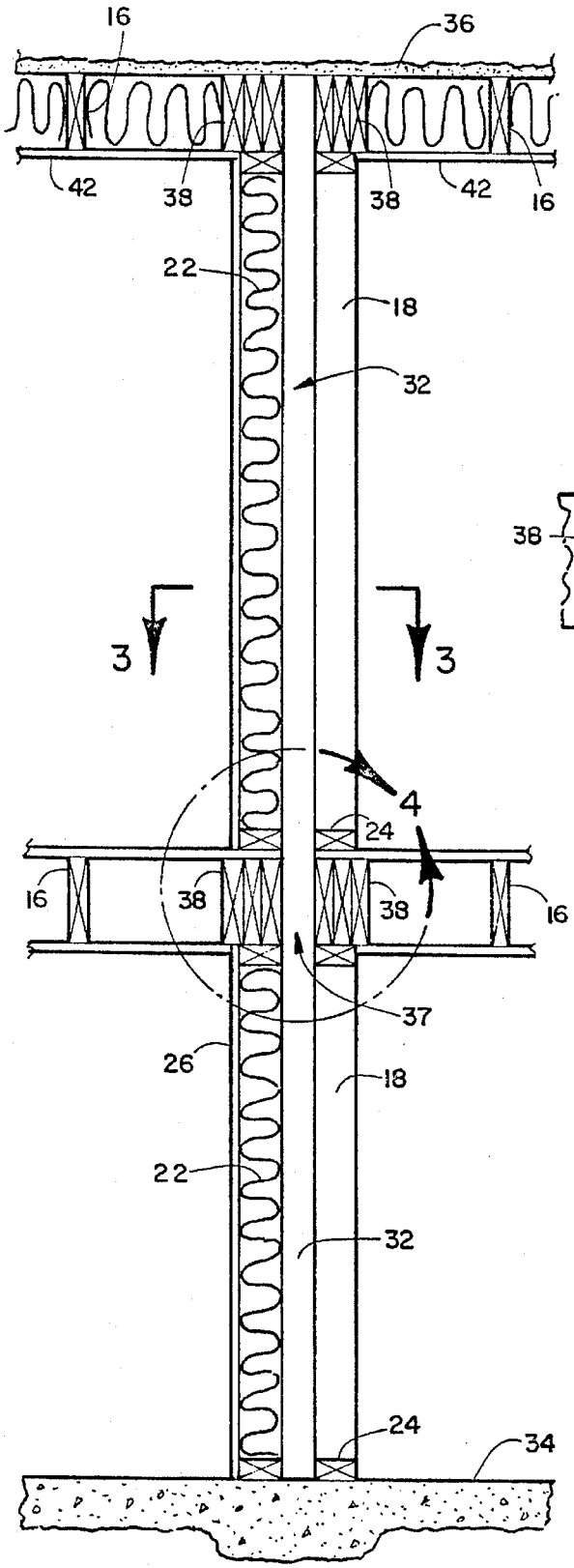
FIG. 2 is a schematic side elevation view of a party wall.

FIG. 2 is a schematic cross sectional elevation view of the common or party walls of a building structure. The party wall has a vertical wall space 32 that runs vertically from its concrete floor pad 34 to its roof 36. There is also a horizontal wall space 37 formed between the respective beams 38. If the proper firewall damns are not installed when the building is constructed, the structure is at a risk to fire leaping through the existing air spaces and causing excessive property damage and the possibility of serious injury or death to occupants. The thicker batts of insulation would fill the spaces between ceiling 42, roof 36, and laterally spaced joist 16 and beams 38.

The novel method for retro-fit forming horizontal and vertical firestops will be best understood by referring to FIGS. 1, 3, 4, and 6. When dealing with two hour firewalls, a first access hole 50, preferably of a square or diamond shape, is cut in drywall panel 28 and the plug 52 removed therefrom. Next a generally round second access hole 54 is cut in drywall panel 26 and plug 56 removed therefrom. If a horizontal firestop is to be formed, these respective access holes are cut in each successive stud bay adjacent the bottom of the stud bay. If a vertical firestop is being formed, the respective access holes are cut in the same stud bay 20 spaced apart from each other a distance H1 which would be in the range of two to four feet.

Next the loose insulation material is fed into a conventional insulation blowing machine 60 having a hose 62 connected thereto. Blowing machine 60 has a bin 110 with a standard picker bar unit 112. Picker bar unit 112 has several fine little teeth on rotating bars that spin very fast and chew up the bulk insulation and fiberize it. A blower 114 draws the fiberized insulation into venturi 116. A hose 118 is connected to a valve 120, a regulator 122 and a water tank 124. The water tank 124 may also have a predetermined amount of glue in it. The water is drawn into venturi 116 where it is mixed with the fiberized insulation as it travels through hose 62. The front end of hose 62 may have a swivel nozzle 64 mounted on it and a sponge 66 mounted adjacent thereto. A specially designed probe tool 100 formed from ¼ inch steel rod has its front end inserted into the access holes to push the batt of insulation away from the access hole and it compresses the insulation rearwardly. Tool 100 has a couple of 90 degree bends 102 and 103 and a handle 105 formed at one end. The swivel nozzle 64 is inserted into the respective access holes 54 and the insulation material is blown therein at a predetermined pressure . The sponge 66 is positioned around the access hole 50 to prevent dust and particulate from escaping from the interior of the stud bay.

Figure 4:
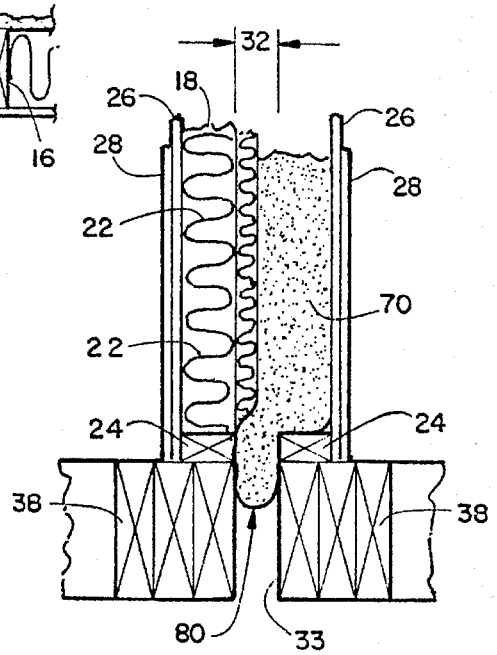
FIG. 4 is a schematic cross sectional view of a horizontal damn.
Figure 7:
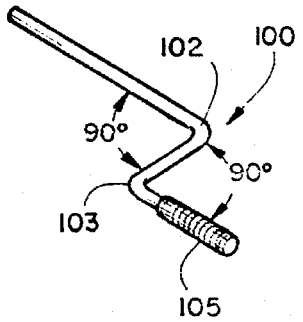
Figure 3:
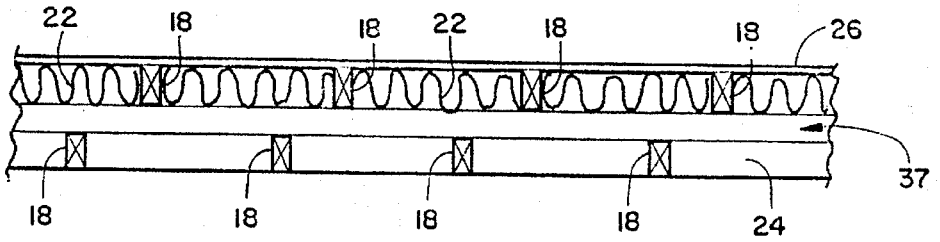
FIG. 3 is a cross sectional view taken along lines 3—3 of FIG. 2.

FIG. 3 is a schematic horizontal cross sectional view showing the staggered studs of the structure forming the party wall. The horizontal space 37 is normally between one to two inches. Blown in insulation 70 fills the horizontal space 33 providing a horizontal firestop 80. A cross sectional view of horizontal firestop 80 is best seen in FIG. 4. The batt of insulation 22 on the side where the insulation is being blown in is compressed too approximately 50% or less of its normal thickness to allow the blown in insulation to fill the gap between the respective bottom plates 24 and beams 38.

Figure 5:
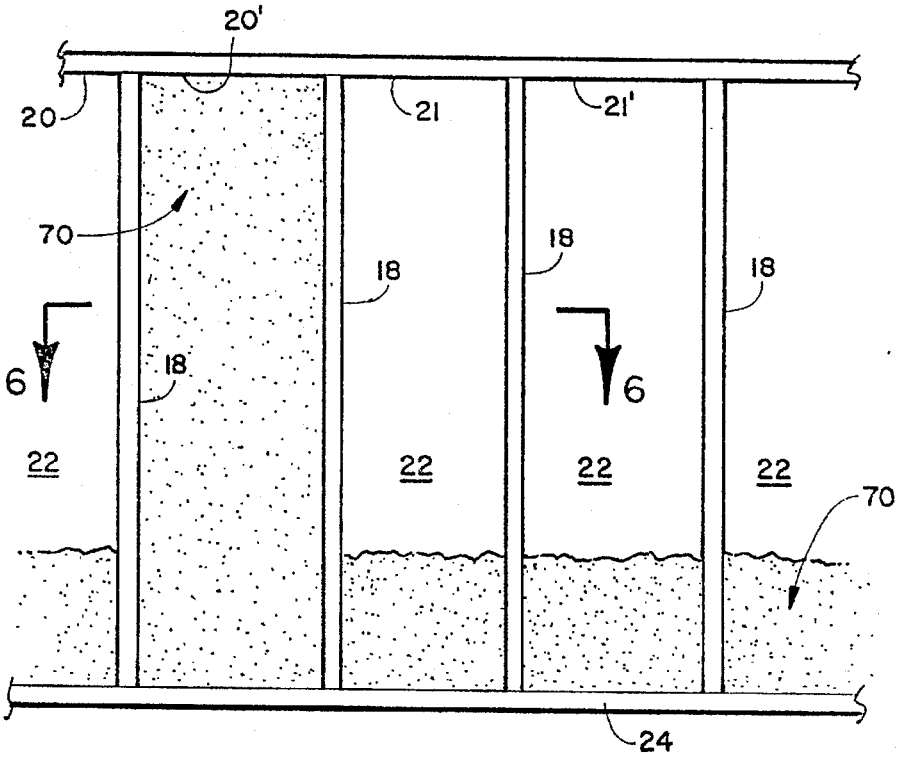
FIG. 5 is a front elevation view of one side of a party wall that has had the retro-fit firestops formed therein with the exterior drywall panel removed for clarity.
Figure 6:
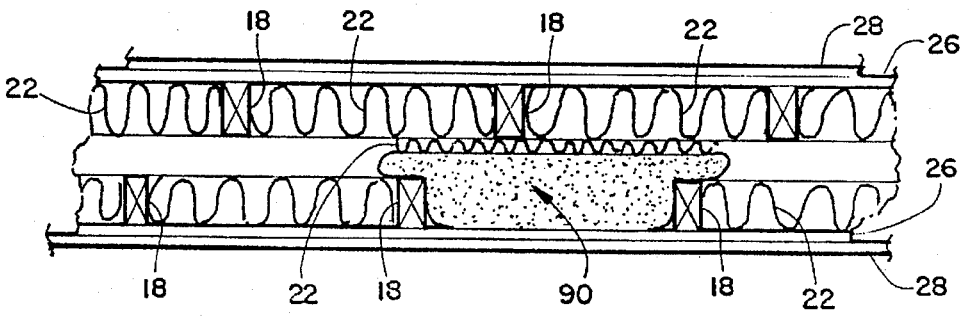
FIG. 6 is a schematic cross sectional view of a vertical firestop.

The completed retro-fit operation for the party wall is best understood by referring to FIG. 5. Here the first and second drywall panels 26 and 28 have been removed to show the manner in which the blown insulation has formed the respective vertical firestop 90 and horizontal firestop 80. Stud bays 20, 20', 21 and 21' are illustrated. All of these stud bays have blown in insulation between the respective studs adjacent their bottom ends thereby forming the horizontal firestop. The remainder upper portion of each of stud bays 20, 21 and 21' have the normal batts of insulation 22. Stud bay 20' is completely filled from top to bottom with blown in insulation to form the vertical firestop. FIG. 6 is a cross sectional view taken along lines 6—6 of FIG. 5 to show how the bead of blown insulation compresses the batt of insulation 22 and completely fills the vertical spacing 32.

What is claimed is:

1. A method of firestoping by (for) retrofit forming horizontal firestop by blowing insulation into selected wall spaces of existing two hour common or party walls of buildings such as apartments and condominiums, said buildings all having conventional structure that has cavities called stud bays formed between laterally spaced vertical studs and these stud bays have (a) an existing batt of insulation filling their cavity, said two hour common or party walls having at least one outer drywall layer that covers a second drywall layer, said two hour common or party walls having an interior and said selected wall spaces being in the interior of said common or party walls and they comprise both vertical spaces and horizontal spaces; said vertical spaces extend from (the) a concrete floor pad of the building to its roof; said horizontal spaces being formed between respective bottom plates of opposing stud bays in said common or party walls; said method comprising the following steps (a) cutting first plugs of drywall in an outer drywall layer of each stud bay to form first access holes adjacent a horizontal floor to expose a second drywall layer, said access holes having a predetermined height H1 and a predetermined width W1;

(b) removing the first plugs of drywall formed by said first access holes;

(c) cutting second plugs of drywall in a second drywall layer of each stud bay to form second access holes, said second access holes being aligned with said first access holes, said second access holes having a predetermined height H2 and a predetermined width W2 and H1 is greater than H2 and W1 is greater than W2;

(d) removing the second plugs of drywall formed by said second-access holes to thereby provide access to the stud bay;

(e) inserting a probe tool into said second access hole and pressing it against (the) an existing batt of insulation to compress it and press it into (the open) a selected wall space between said common or party walls;

(f) inserting an end of a nozzle of an insulation blowing machine into said second access holes and blowing a specially prepared loose insulation material into said horizontal spaces to create a horizontal material (damn) dam between the respective bottom plates of opposing stud bays and said insulation material is compressed into place;

(g) removing said nozzle from each of said second access holes after a horizontal material (damn) dam has been formed;

(h) replacing said second plugs of drywall into their respective second access holes and securing them in place;

(i) replacing said first plug members into their respective first access holes and securing them in place.

2. The method recited in claim 1 further comprising the steps of (i) taping and finish coating said first access holes using standard drywall methods.

3. The method recited in claim 1 wherein said first access holes are positioned vertically within 12 inches of said horizontal floor or said ceiling.

4. A method of firestoping by (for) retrofit forming horizontal firestops by blowing insulation into selected wall spaces of existing one hour common or party walls of buildings such as apartments and condominiums, said buildings all having conventional structure that has cavities called stud bays formed between laterally spaced vertical studs and these stud bays have (a) an existing batt of insulation filling their cavity, said one hour common or party walls having a drywall layer, said one hour common or party walls having an interior and said selected wall spaces being in the interior of said common or party wall and they comprise both vertical spaces and horizontal spaces; said vertical spaces extend from (the) a concrete floor pad of the building to its roof; said horizontal spaces being formed between respective bottom plates of opposing stud bays in said common or party walls, said method comprising the following the steps of:

(a) cutting plugs in the drywall layer of each stud bay to form access holes adjacent a horizontal floor, said access holes having a predetermined height H1 and a predetermined width W1;

(b) removing the plugs of drywall formed by said access holes to thereby provide access to the stud bay;

(c) (pushing any insulation inside the access holes of each stud bay away from the mouth of the hole and compressing it a predetermined amount;) inserting a probe tool into said access hole and pressing it against (the) an existing batt of insulation to compress it and also press it into (the open) a selected wall space between said common or party walls;

(d) inserting an end of a nozzle of an insulation blowing machine into said access holes (until it is adjacent the floor plate line) and blowing a specially prepared loose insulation material into said horizontal spaces to create a horizontal material (damn) dam between the respective bottom plates of opposing stud bays and said insulation material is compressed into place:

(e) removing said nozzle from each of said access holes after a horizontal material (damn) dam has been formed;

(f) replacing said plugs into the respective access holes and securing them in place.

5. The method recited in claim 4 further comprising the step (g) taping and finish coating said access holes using standard dry wall methods.

6. The method recited in claim 4 wherein said access holes are positioned vertically within 12 inches of said horizontal floor or said ceiling.

7. A method of firestoping by retro-fit forming vertical firestops by blowing insulation into selected wall spaces of existing two hour common or party walls of buildings such as apartments and condominiums, said buildings all having conventional structure that has cavities called stud bays formed between laterally spaced vertical studs and these stud bays have an existing batt of insulation filling their cavity, said two hour common or party walls having at least one outer drywall layer that covers a second drywall layer, said two hour common or party walls having an interior and said selected wall spaces being in the interior of said common or party walls and they comprise both vertical spaces and horizontal spaces; said vertical spaces extend from a concrete floor pad of the building to its roof; said horizontal spaces being formed between respective bottom plates of opposing stud bays in said common or party walls; said method comprising the following steps of:

(a) cutting a plurality of vertically spaced first plugs of drywall in an outer drywall layer of a stud bay to form first access holes adjacent a vertically extending stud to expose a second drywall layer, said first access holes having a predetermined height H1 and a predetermined width W1;

(b) removing the first plugs of drywall formed by said first access holes;

(c) cutting second plugs of drywall in a second drywall layer of each stud bay to form second access holes, said second access holes being aligned with said first access holes, said second access holes having a predetermined height H2 and a predetermined width W2 and H1 is greater than H2 and W1 is greater than W2;

(d) removing the second plugs of drywall formed by said second access holes to thereby provide access to the stud bay;

(e) inserting a probe tool into said second access hole and pressing it against an existing batt of insulation to compress it and press it into a selected wall space between said common or party walls;

(f) inserting an end of a nozzle of an insulation blowing machine into said second access holes and blowing a specially prepared loose insulation material into said vertical space to create a vertical material dam in the vertical space adjacent said vertically extending stud and said insulation material compressed into place;

(g) removing said nozzle from each of said second access holes after a vertical material dam has been formed;

(h) replacing said second plug of drywall into their respective second access holes and securing them in place;

(i) replacing said first plug members into their respective first access holes and securing them in place.

8. The method recited in claim 7 further comprising the step of (h) taping and finish coating said first access holes using standard drywall methods.

9. A method recited in claim 7 wherein said first access holes are positioned horizontally within 12 inches of said vertically extending studs.

10. A method of firestoping by retro-fit forming vertical firestops by blowing insulation into selected wall spaces of existing one hour common or party walls of buildings such as apartments and condominiums, said buildings all having conventional structure that has cavities called stud bays formed between laterally spaced vertical studs and these stud bays have an existing batt of insulation filling their cavity, said one hour common or party walls having a drywall layer, said one hour common or party walls having an interior and said selected wall spaces being in the interior of said common or party walls and they comprise both vertical spaces and horizontal spaces; said vertical spaces extend from a concrete floor pad of the building to its roof; said horizontal spaces being formed between respective bottom plates of opposing stud bays in said common or party walls, said method comprising the following the steps of:

(a) cutting a plurality of vertically spaced plugs in the drywall layer of a stud bay to form access holes adjacent a vertically extending stud, said access holes having a predetermined height H1 and a predetermined width W1;

(b) removing the plugs of drywall formed by said access holes;

(c) inserting a probe tool into said access hole and pressing it against an existing batt of insulation to compress it and also press it into a selected wall space between said common or party walls;

(d) inserting an end of a nozzle of an insulation blowing machine into said access holes and blowing a specially prepared loose insulation material into said vertical spaces to create a vertical material dam in the vertical space adjacent said vertically extending stud and said insulation material is compressed into place;

(e) removing said nozzle from each of said access holes after a vertical material dam has been formed;

(f) replacing said plugs into the respective access holes and securing them in place.

11. The method recited in claim 10 further comprising the step (f) taping and finish coating said access holes using standard drywall methods.

12. The method recited in claim 10 wherein said access holes are positioned vertically within 12 inches of said vertically extending stud.

* * * * *